US006006906A

United States Patent [19]

Winnard

[11] Patent Number: 6,006,906

[45] Date of Patent: Dec. 28, 1999

[54] MAGNETIC TOOL HOLDING AND STORAGE APPARATUS

[76] Inventor: Stanley D. Winnard, 2528 Clearspring Dr., Irving, Tex. 75063

[21] Appl. No.: 09/009,981

[22] Filed: Jan. 21, 1998

[51] Int. Cl.[6] ..... A45C 11/26

[52] U.S. Cl. ..... 206/350; 206/376; 206/818

[58] Field of Search ..... 206/372, 373, 206/376, 377, 378, 818, 350

[56] References Cited

U.S. PATENT DOCUMENTS

| | | | |
|---|---|---|---|
| 3,808,918 | 5/1974 | Carr | 81/125 |
| 4,427,247 | 1/1984 | Petersen | 339/14 |
| 4,591,817 | 5/1986 | Miller | 335/285 |
| 4,663,998 | 5/1987 | Parsons et al. | 81/125 |
| 4,802,580 | 2/1989 | Andersen | 206/378 |
| 5,080,230 | 1/1992 | Winnard | 206/350 |
| 5,146,814 | 9/1992 | Vasichek | 81/125 |
| 5,199,334 | 4/1993 | Vasichek et al. | 81/125 |
| 5,259,278 | 11/1993 | Leas | 81/180 |
| 5,277,088 | 1/1994 | Vasichek et al. | 81/125 |
| 5,313,181 | 5/1994 | Negus | 335/285 |
| 5,343,181 | 8/1994 | Negus | 335/285 |
| 5,500,631 | 3/1996 | Negus | 335/285 |
| 5,501,342 | 3/1996 | Geibel | 206/378 |
| 5,542,320 | 8/1996 | Vasichek et al. | 81/125 |
| 5,660,276 | 8/1997 | Winnard | 206/378 |

OTHER PUBLICATIONS

Flexible Magnets, on Internet at www.magnetsales.com/flexible.html.

Alnico Magnets, on Internet at www.magnetsales.com/alnico.html.

Permanent Magnet, on Internet at www.jesus.cam.ac.uk/~jfn95/Elec4.html.

Rare Earth Magnets, on Internet at www.magnetsales.com/rare_earth.html.

Ceramic Magnets, on Internet at www.magnetsales.com/ceramic.html.

Improved powder Metallurgy Magnetic Materials, on Internet at www.inel.gov/technology_transfer/success/powder.html.

*Primary Examiner*—Jacob K. Ackun

*Attorney, Agent, or Firm*—Sanford E. Warren, Jr.; Edwin S. Flores; Gardere & Wynne, L.L.P.

[57] ABSTRACT

An apparatus for storing and organizing tools comprising, a generally J-shaped channel (12) having first and second sides (22, 26) and an opening (20), a first magnet (14) disposed within the opening (20), a second magnet (15) disposed along the first side (22) opposite the opening (20) and a magnetically conductive plate (16) positioned on the first magnet (14) disposed within the opening (20), is disclosed.

25 Claims, 7 Drawing Sheets

MAGNETIC TOOL HOLDING AND STORAGE APPARATUS

TECHNICAL FIELD OF THE INVENTION

The present invention is directed to an apparatus for storing and holding tools, more particularly, it relates to an apparatus for storing and organizing small hand tools by positioning a permanent magnet within a holder.

BACKGROUND OF THE INVENTION

Without limiting the scope of the invention, the background is described in connection with the storage and organization of small hand tools using the combination of a magnet and device to hold the magnet relative to hand tools in storage.

Heretofore, in this field, small hand tools and implements have been organized using, for example, pressure fitted holders. One example of such a pressure-fitted holder has a variety of small spring clips that are connected to a central rail in which sockets are positioned in the outward protrusion from the spring clips. The spring clips can be configured to insert the drive opening of a socket. Spring clips can also be designed to hold other small tools, such as a ratchet for driving the sockets or for a screwdriver.

The spring clips are designed to insert the drive ends of, e.g., ¼ inch, ⅜ inch, or ½ inch square drive ratchet sockets. One disadvantage of this system, however, is the limitation imposed by the size of the different socket drivesizes as the spring clips must match the specific socket size.

Another problem associated with the use of spring clip socket holders is they can easily become deformed during use so that the socket fits too tightly or too loosely. If the spring clip becomes loose, a socket can easily become dislodged from the spring clip. Conversely, if the spring clip is deformed so that it fits too tightly within the socket drive opening, it becomes difficult to attach and remove the socket from the clip. Attempts to either adjust the tightness of the spring clip or to withdraw a socket that is held too tightly to the clip, can cause adjacent sockets to be dislodged.

Furthermore, spring clips have been forbidden for use in the aircraft industry because of their potential as a foreign object or debris (FOD). FOD is a major problem in the aircraft industry due to reliance in the industry on highly efficient jet engines. Highly efficient jet engines are obtained at the cost of decreased ruggedness. Because the worldwide airline industry is turning toward more efficient engines, the interior of these engines must be protected from FOD.

In the past, there have been various constructions combining molded, nonmetallic materials with magnets to provide a holder for metal sockets. See, for example, my U.S. Pat. No. 5,080,230. U.S. Pat. No. 3,405,377 issued to Pierce discloses a construction that includes a series of parallel boards of nonmetallic material. U.S. Pat. No. 4,591,817 issued to Miller discloses a socket holder that includes plate armatures that are laminated with magnetic material to define an assembly for holding sockets. U.S. Pat. No. 4,802,580 issued to Anderson discloses a construction where parallel plates sandwich the magnetic material. To facilitate the alignment of items being retained, a third parallel plate is provided. U.S. Pat. No. 5,500,631 issued to Negus discloses a magnetic holder that includes a molded plastic tray with a sinter bar having laminated keeper plates and magnetic bars positioned to define pole pieces that permit the forming of magnetic circuits.

All of these prior designs, however, have like flaws. The first flaw is that these magnetic socket holders are unable to maintain the weight of numerous sockets for a prolonged period of time. During use in industry, it has been found that the magnetic strength of these holders decreases as more sockets are added causing the socket holder to fail unless maintained in the horizontal position.

U.S. Pat. No. 5,501,342 issued to Geibel discloses a magnetic socket track that includes a base with concave grips the length of the outer sides. Two sections of ferrous metal with 90 degree bends lie inside the channel with the protrusions of the 90-degree bends facing each other. While the disclosed invention provides adequate magnetic support, as disclosed, the socket tracks have the same problems associated with spring clip assemblies, namely, that the numerous components can be dislodged, lost and may become FOD.

U.S. Pat. No. 4,802,580 issued to Andersen discloses a pair of elongated, parallel and laterally spaced armature plates in which a plurality of magnets are mounted in positions spaced along the plates. The plates are constructed of ferrous material. The armature plates are assembled using a plurality of threaded fasteners that extend through the multiple plates and secure the armature plates. Due to the complexity of assembling the unit and the use of multiple small parts that comprise the magnetic socket holders described therein, the invention fails to address the requirements for reduced components; components that may become entrapped in a jet engine, i.e., FOD. Furthermore, the unit requires multiple steps for assembly, making automation of manufacturing the unit difficult and expensive.

The present invention addresses the need for a universal magnetic tool organizer that is small, reliable and reduces foreign objects and debris (FOD). While the requirement for reduced FOD in the airline industry is apparent, similar needs are found in mechanic shops because of the need for safety, reduced cost due to lost time finding tools and savings from a reduced need in the replacement of tools. The present invention also addresses the need for vertical stackability of tool organization and for rapid automated assembly of the tool holder and placement of the tools in the holder.

SUMMARY OF THE INVENTION

The present invention is directed to a tool holder comprising a channel, a magnet disposed within the channel and a magnetically conducting plate over the magnet. The width of the channel can vary to accommodate, for example, smaller and larger sockets. Alternatively, other tools such as pliers, wrenches, ratchets and the like can be retained by contacting them with the magnetically conducting plate.

More particularly, the present invention is directed to an apparatus for holding and organizing tools comprising, a channel having first and second sides, a first magnet disposed within the channel and a magnetically conductive plate positioned on the magnet within the channel. The apparatus of the present invention may further comprise a second magnet disposed along the first side of the channel.

A wide variety of different magnets, including permanent magnets, may be used as either the first or the second magnet. Magnets that may be used with the present invention include neodymium, Alnico, ceramic or flexible magnets.

In another embodiment of the present invention the apparatus may further comprise a side plate that is disposed on each end of the first magnet within the channel. A handle may be connected to the side plates, which permits a user to carry the apparatus of the present invention. The attachment of the handle may be made using a rivet or like attachment, or may be permanently fixed by soldering or otherwise permanently affixing the handle to the side plate. In the former instance, the handle may be pivotable about its attachment.

In yet another embodiment, the first magnet is a unipolar magnet and the second magnet is a multipolar magnet. The first and second magnets may be attached to the channel by an adhesive, or may rely solely on magnetic forces to attach to a metallic or magnetically conductive tool holder channel. The second magnet may also serve to attach the apparatus of the present invention in a vertical organization system. The second magnet may be integral to the apparatus of the present invention or to a vertical storage system.

In yet another embodiment, a formed lip on the top edge of the first side is used to enhance the deployment of the present invention along the edge of a metallic surface or deploy along the edge of a non-magnetic surface such as a wooden joist, tool box or the like. In yet another embodiment, the formed lip may be on the second side or side plates. Alternating embodiments can have the formed lip without the second magnet.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE PREFERRED EMBODIMENTS

Figure 1A:
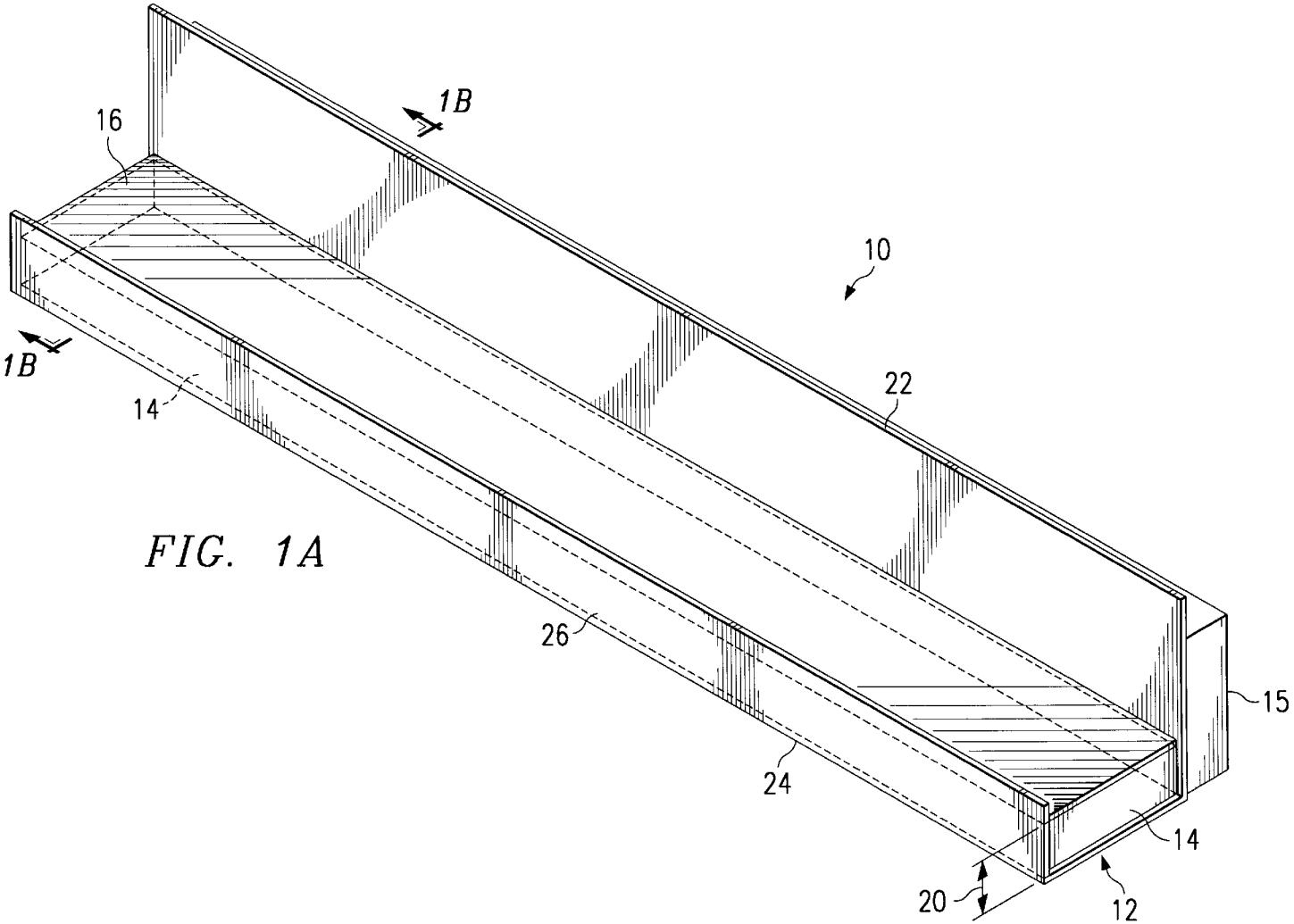
FIG. 1A is a diagram of one embodiment of the tool holder of the present invention.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

The present invention, described herein, is described using sockets as the tools being supported by the tool holder of the present invention. Other tools, however, can be used and supported by the tool holder of the present invention described herein, as will be known to one of ordinary skill in the art in light of the present disclosure.

A wide variety of magnets may be used with the present invention such as rare earth magnets, ceramic magnets, alnico magnets, permanent magnets and flexible magnets. Flexible magnets are made by impregnating a flexible material such as neoprene rubber or a plastic with a material such as iron flakes having magnetic characteristics.

Examples of rare earth magnets include neodymium iron (NdFeB) and Samarium Cobalt (SmCo) classes of magnets. Within each of these classes are a number of different grades that have a wide range of properties and application requirements. Rare earth magnets are available in sintered as well as bonded form. The bonded form of the material can be produced with little or no finish. For use with the present invention, however, more finished materials will be preferred when using the tool holder of the present invention in the airline industry.

Ceramic magnets are sintered permanent magnets composed of Barium Ferrite ($BaO\ (Fe_2O_3)_n$) or Strontium Ferrite ($SnO\ (Fe_2O_3)_n$), where n is a variable quantity of ferrite. Also known as anisotropic hexaferrites, this class of magnets is useful due to its good resistance to demagnetization and its low cost. While ceramic magnets tend to be hard and brittle, requiring special machining techniques, these magnets can be used in tool holders having very precise specifications. Anisotropic grades are oriented during manufacturing, and must be magnetized in a specified direction.

Ceramic magnets can also be isotropic, and are often more convenient due to their lower cost. Ceramic magnets are useful in a wide range of applications and can be pre-capped or formed for use with the present invention. Ceramic magnets are very corrosion resistant, however, they do require some form of coating for use in the airline industry due to the formation of powder-like material. Therefore, a coating for the ceramic magnets is suggested to eliminate sloughing and chipping of the magnet.

Flexible magnets are magnets made of materials that are flexible and coated with a magnetic material. Flexible magnets offer the product designer a uniquely desirable combination of properties at a low cost. The advantage of materials that are flexible and coated with a magnetic compound is that they can be bent, twisted, coiled die punched, and otherwise machined into almost any shape without loss of the magnetic field. Under normal working conditions, flexible magnets are desirable due to their lack of a need for coating, are corrosion resistant, are easily machined, are easily handled, and can be coated with magnetic material having a high magnetic energy.

More expensive magnetic material, such as rare earth metal magnets, can be coated onto a flexible backing material, such as plastic, nylon or polypropylene, and will provide excellent magnetic strength and flexibility. In addition, the flexible magnets can be made very thin, e.g., with thicknesses of 1/18th of an inch or less.

Flexible magnets may also be attached to the tool holder of the present invention using adhesives that are suitable for a wide range of environments. The type of adhesive used to attach the flexible magnet will depend on the particular application, for example, the adhesive can be pressure sensitive. Laminate adhesive materials can be used to form laminate-type magnets. In addition, a plurality of adhesives can be used with the present invention.

Alnico magnets are composed primarily of alloys of aluminum, nickel and cobalt and are characterized by excellent temperature stability, high residual inductions, and relatively high energies. Alnico magnets are manufactured through either a casting or sintering process. Cast magnets can be manufactured to very high specifications and can have very specific shapes. Sintered alnico magnets offer slightly lower magnetic properties but better mechanical characteristics than cast magnets.

Alnico magnets are very corrosion resistant and are generally plated for cosmetic reasons. Coating may be particularly useful for cast alnico magnets because they are hard, brittle and prone to chipping and cracking. One disadvantage of alnico magnets is that they are easily demagnetized, however, this problem can be overcome with simple handling instructions. Advantage of alnico magnets is the smaller effect that temperature has on magnetic properties.

Referring now more specifically to the drawings, the numeral 10 generally designates a tool holder of the present invention in FIG. 1A. A tool holder 10 is disclosed and comprises a channel, such as a J-shaped channel 12, for example. A first magnet 14 is disposed within the opening 20 formed within the J-shaped channel 12. Above first magnet 14 within opening 20 is a magnetically conductive plate 16. The J-shaped channel 12 is made of a ferrous material, or a material that has been coated with a ferrous material.

The J-shaped channel 12 has a first side 22, a bottom 24 and a second side 26. The first side 22 is longer than the second side 26 and serves to provide lateral support to the side of a tool in the tool holder 12. A second magnet 15 is disposed along the surface of the first side 22. The J-shaped channel 12 is made of a magnetically conductive material, which can be a ferrous material or another material that contains sufficient magnetically conductive material to transfer or attain magnetic qualities.

A variety of different first and second magnets 14, 15 may be used with the present invention. In one embodiment of the present invention, the first magnet 14 that is disposed within the opening 20 along bottom 24 is a uni-polar magnet in which the magnetic fields protrude from the ends of the first magnet 14 and transfer their magnetic potential to the magnetically conductive plate 16. The second magnet 15 that is disposed along the first side 22, in one embodiment of the present invention, is a multi-polar magnet in which a series of magnetic fields are formed perpendicular to the surface of the second magnet 15. The magnetic field components of a multi-polar second magnet 15 that is positioned parallel to first side 22 of J-shaped channel 12 may be of about 1/16th to 1/8th of an inch in thickness.

Figure 1B:
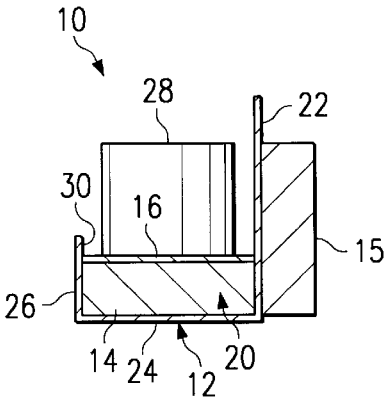
FIG. 1B through 1G are cross-sectional views along the 1–1' line of alternative embodiments of a tool holder.

FIG. 1B is a cross-sectional view of the tool holder 10 of the present invention along line 1–1' of FIG. 1A. A socket 28 has been added to FIG. 1B as an example that tends to show the relative proportions and positioning of the tool holder 10 of the present invention when used to hold a socket 28. The J-shaped channel 12 of the present invention is depicted having its first side 22, bottom 24 and second side 26 made of a single piece of magnetically conductive material. Alternatively, the J-shaped channel 12 can be made of separate pieces of magnetically conductive material that are soldered together to form the first side 22, bottom 24 and second side 26.

In the airline maintenance industry, however, the uni-plate J-shaped channel 12 is preferred because of the reduced possibility of FOD. A lip 30 is depicted in FIG. 1B and is formed in the region between the magnetically conductive plate 16 and the upper portion of the second side 26, and serves to provide lateral support and help in the retention of a tool, such a socket 28, within the tool holder 10 of the present invention. While the socket 28 depicted in FIG. 1B will be primarily attracted to second magnet 15 that is disposed along the first side 22 for lateral support, the lip 30 provides additional mechanical support for the socket 28 opposite the first side 22. The socket 28 is secondarily attracted to the second magnet 15 that is within opening 20 of the J-shaped channel 12.

Figure 1E:
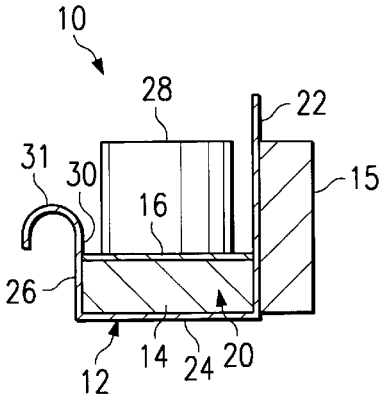
Figure 1C:
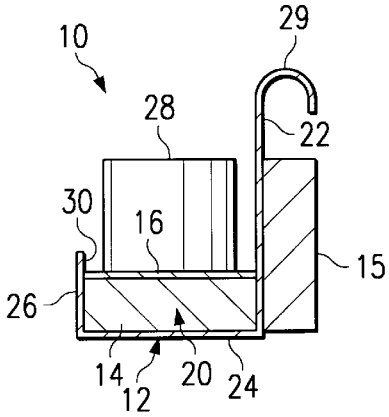
Figure 1F:
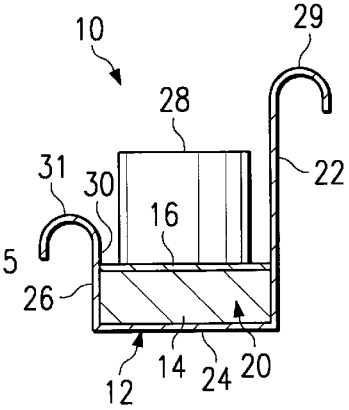
Figure 1D:
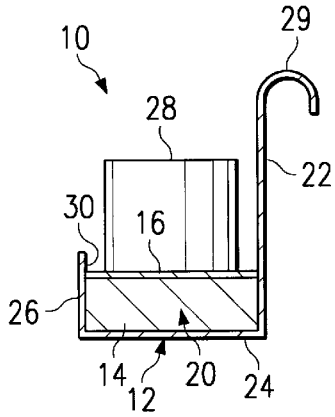

FIGS. 1C through 1F show alternative embodiments of the tool holder 10 in cross-sectional review along the 1–1' line of FIG. 1A. FIG. 1C shows a configuration where an additional first formed lip 29 has been added at the end of first side 22, and which can be used to provide additional mechanical support to the tool holder 10. FIG. 1D shows an alternative embodiment in which the second magnet 15 has been removed and the first formed lip 29 provides all the support for tool holder 10.

Figure 1G:
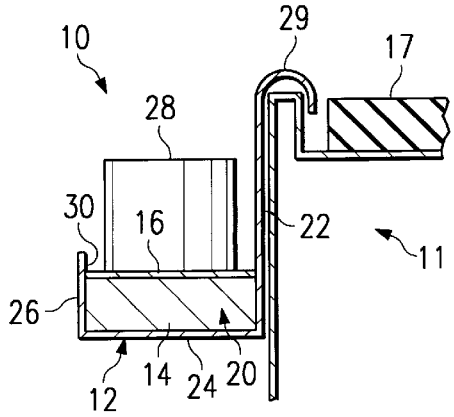

FIGS. 1E and 1F show cross-sectional views of alternative embodiments of tool holder 10 in which a second formed lip 31, extending from lip 30 of second side 26 of J-shaped channel 22 is depicted. The second formed lip 31 can provide mechanical support for socket 28, as well as, provide mechanical attachment for the tool holder 10. FIG. 1F has both first and second formed lips 29, 31, in which case either or both may be used for supporting the tool holder 10. FIG. 1G shows a tool holder 10 attached to a tool stand 11 which can have, e.g., a tool mat 17 on its top surface. The tool holder 10 depicted in FIG. 1G is attached to the tool stand 11 by first formed lip 29. In an alternative embodiment, a magnet (not depicted) is disposed between the tool holder 10 and the tool stand 11. Tool stand 11 can be, for example, a stand alone tool rack or a support structure attached to a wall or other firm object.

Figure 2B:
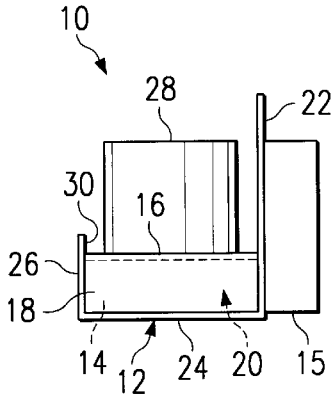
FIG. 2B is a side view of the embodiment depicted in FIG. 2A of the present invention in which the side plate does not traverse the plane of the tool.
Figure 2C:
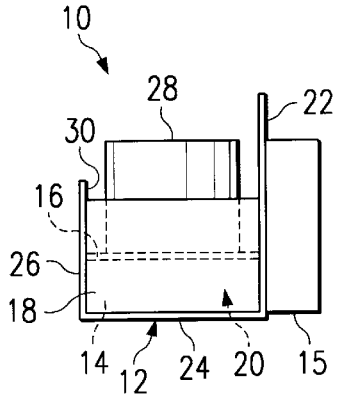
FIG. 2C is a side view of FIG. 2A and depicts an embodiment in which the side plate does cross the plane of the tool.
Figure 2A:
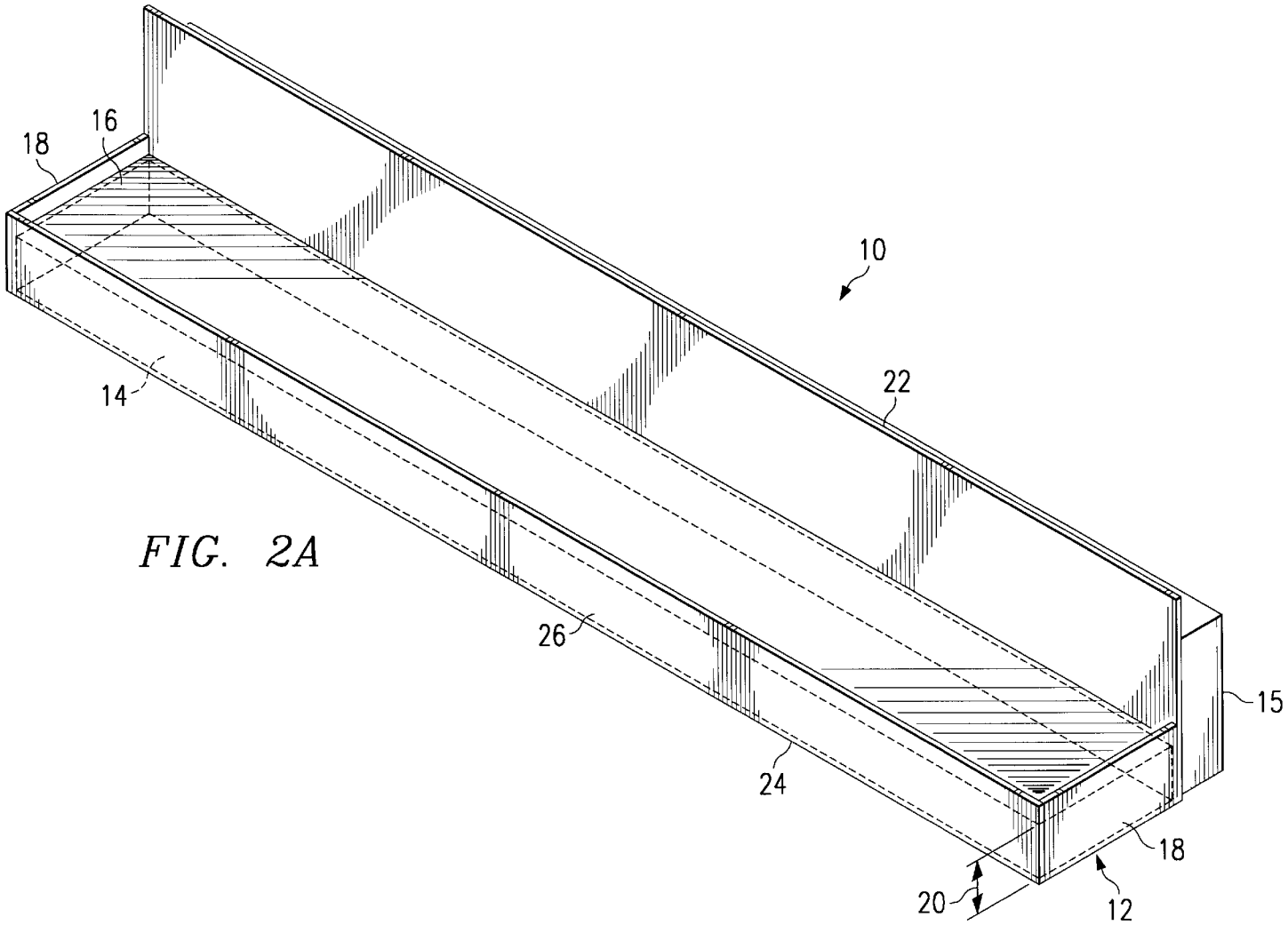
FIG. 2A is a cross-sectional view of an alternative embodiment of the tool holder of the present invention.

FIG. 2A shows an alternative embodiment of the tool holder 10 of the present invention. The tool holder 10, as depicted, has a J-shaped channel 12, first magnet 14, magnetically conductive plate 16 and side plates 18. The side plates 18 can be welded to the J-shaped channel 12 or can be cast or die punched from a single plate and molded into the J-shape channel 12 depicted in FIG. 2A.

FIGS. 2B and 2C show two alternative embodiments for the positioning and size of the side plates 18. In FIG. 2B, the side plates 18 are depicted holding the first magnet 14 but do not provide lateral mechanical support for socket 28. Note that it is a preferred embodiment that the magnetic strips not contact the sides of the holder, but only the bottom of the channel 12. An alternative embodiment shown in FIG. 2C, side plates 18 extend above the plane of the magnetically conductive plate 16 and provide lateral additional mechanical support to the socket 28. Also depicted in FIG. 2C is a second side 26 of the J-shaped channel 12 that is longer than those depicted in previous figures and which extends to form a lip 30 that provides greater lateral mechanical support to the socket 28.

Figure 3:
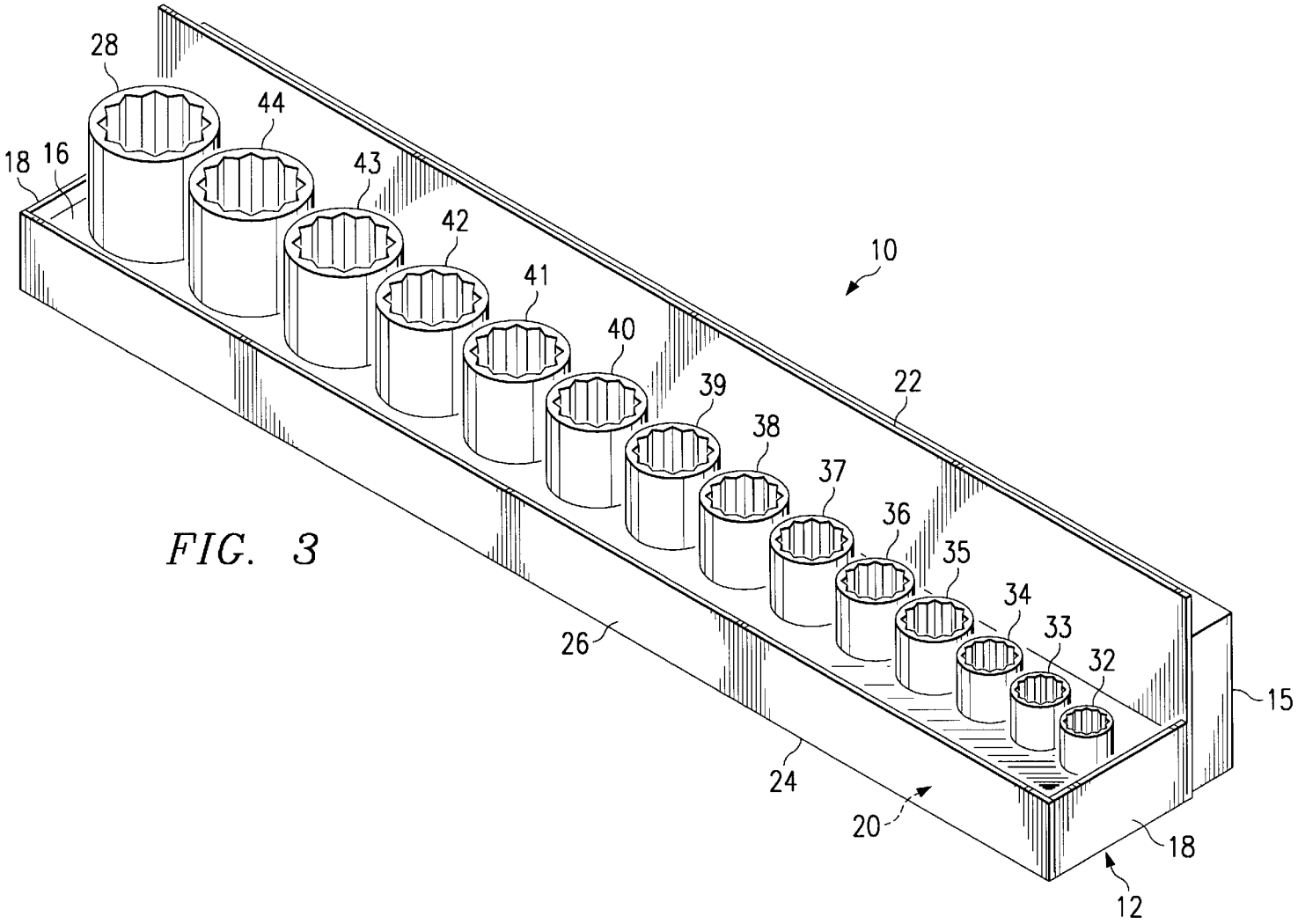
FIG. 3 is a diagram of an alternative embodiment of the tool holder of the present invention.

FIG. 3 shows an alternative embodiment of the tool holder 10 having a plurality of sockets 28 of varying shapes and sizes. The J-shaped channel 12 depicted in FIG. 3 varies in width along the length of the J-shaped channel 12 to accommodate smaller sockets 32–38. As the size of the sockets increases, the width of the opening 20 increases accordingly, thereby accommodating the greater width of the sockets 28 and 32–44. The height of the first side 22 and the J-shaped channel 12 can be increased to provide lateral support to the sockets 28, 32–44. The height of the first and second sides 22, 26 and width of the opening 20 can remain constant or change, depending on the structural and design needs of the user.

Not visible in FIG. 3 are the first and second magnets 14, 15 but these can either maintain their width or increase with the width of the opening 20 and the first side 22 of the J-shaped channel 12. The tool holder 10 depicted in FIG. 3 also has side plates 18 that help retain the sockets 28, 32–44 within the tool holder 10.

One advantage of using the tool holder 10 depicted in FIG. 3 is that it allows for easy positioning of sockets within the opening 20, a procedure that is presently done manually in assembly plants and which can be automated using the tool holder 10 of the present invention. Yet another advantage of the tool holder 10 of the present invention is that it allows for easy positioning of the sockets 28, 32–44 within the channel and allows for easy identification of the sockets 28, 32–44. The present invention also permits attachment of a combination of hand tools, such as sockets, a ratchet and pliers, for example.

Figure 4:
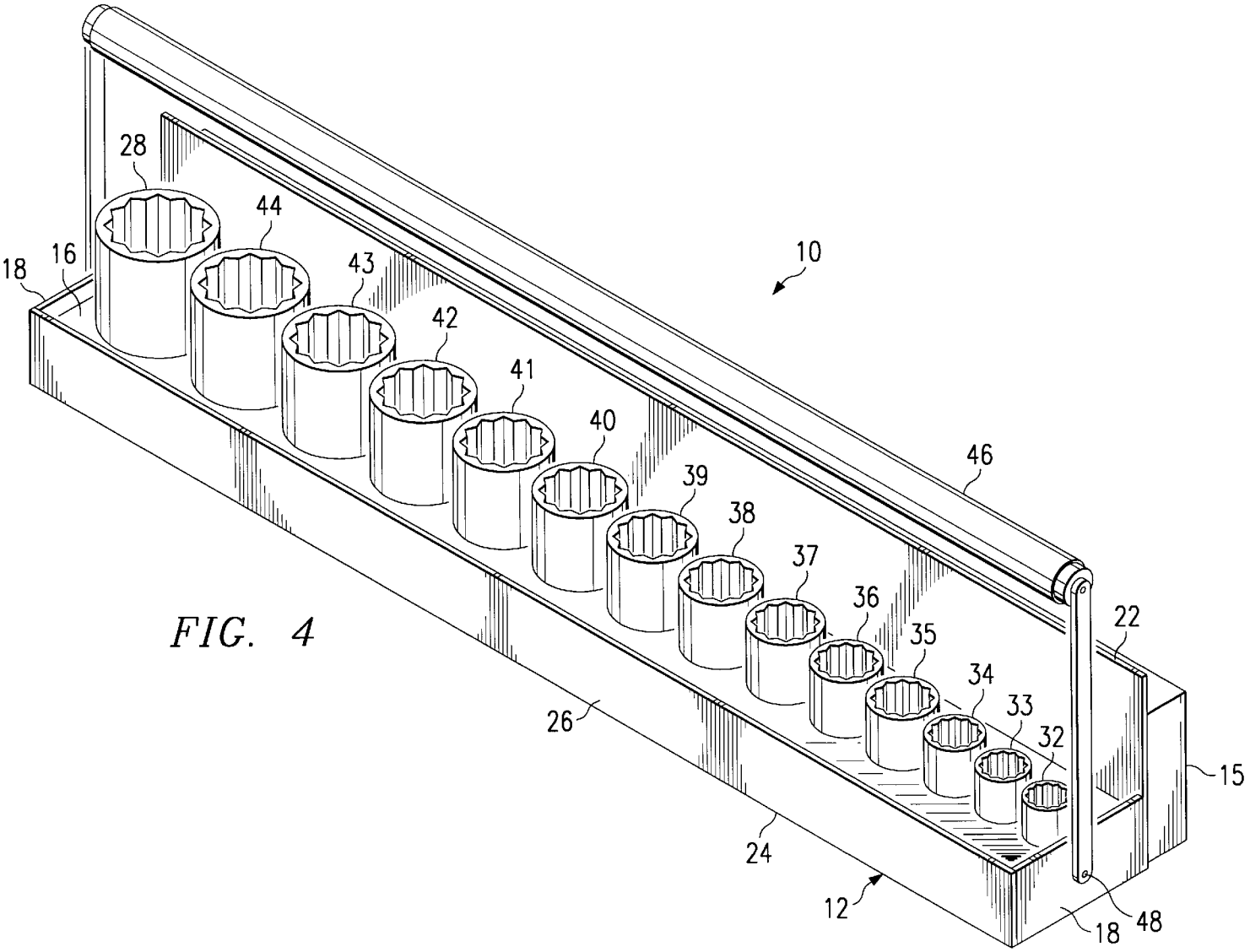
FIG. 4 is a diagram of another embodiment of the tool holder of the present invention shown with a handle.

FIG. 4 shows yet another embodiment of the tool holder 10 of the present invention having a handle 46 that is attached to the side plates 18 and allows the user of the tool holder 10 to carry the tool holder 10. Alternative places of attachment for the handle 46 are possible and are within the scope of the present invention, and may even replace side plates 18, for example.

In addition to being able to carry the tool holder 10 using the handle 46, the handle 46 can increase in height as the socket size increases between socket 32 and socket 44, providing a visual guide for correct positioning of the tools. The attachment of the handle 46 to the side plates 18 can be done by means of a rivet 48 which permits for a rotation of the handle 46 to the front or back of the tool holder 10. Alternatively, the handle 46 can be welded to the side plates 18 so as to prevent the possibility of small components becoming FOD.

Figure 5:
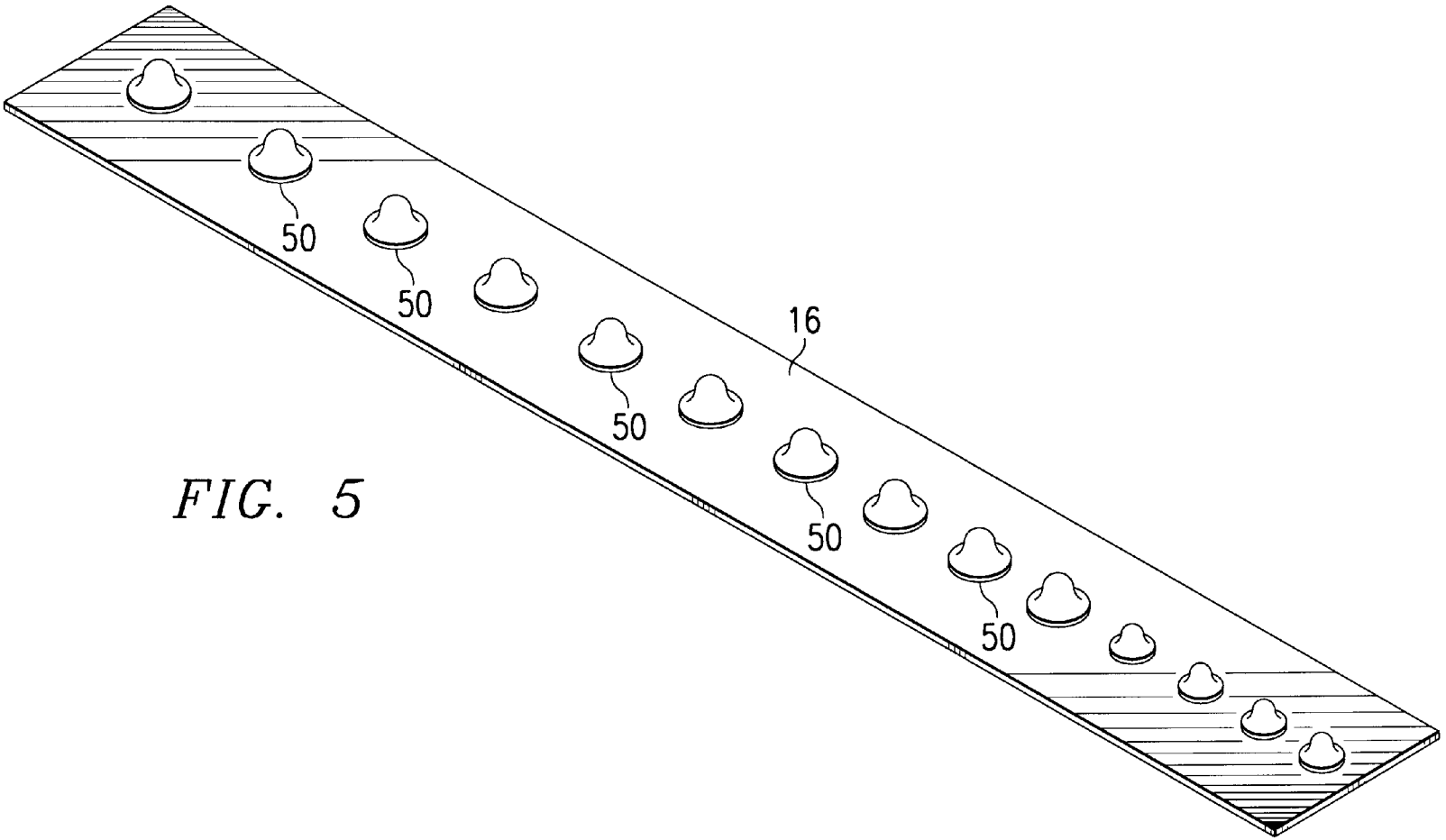
FIG. 5 is a diagram of the magnetically conductive plate for use with the present invention having indentations.

FIG. 5 shows, in isolation, an alternative embodiment of the magnetically conductive plate 16 of the present invention. While the magnetically conductive plate 16 depicted in FIG. 5 does not increase in width, alternative embodiments encompassed herein would include changes in width as would be appropriate for use with the tool holder 10 depicted in FIGS. 3 and 4, and depending on the tools being supported.

Indentations 50 are depicted on the surface of the magnetically conductive plate 16 and can be used to position, for example, sockets 28, 32–44 within the tool holder 10 of the present invention. The indentations 50 can be positioned equidistant or the distance between the indentations 50 can increase or decrease depending on the size of the tool that is positioned within the tool holder 10. Using sockets 28, 32–44 as an example, the indentations can fit within the ratchet attachment of the sockets 28, 32–44, and provide positioning of the sockets 28, 32–44 within the tool holder 10. The magnetically conductive plate 16 can also have areas with and without indentations 50, to accommodate other tools.

Figure 6A:
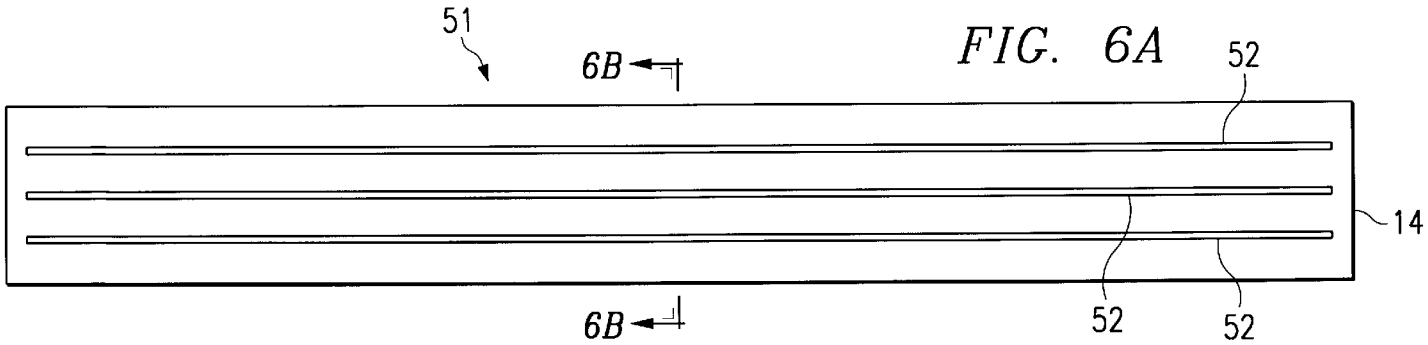
FIGS. 6A and 6B show a plan and end view of the magnet for use with the present invention, illustrating rows of magnetic particle materials embedded in a multi-polar manner.

FIG. 6A is a top view of a multi-polar magnet 51 for use with the present invention. A flexible strip material, such as a nonmetallic binding material having a magnetic material 52 disposed therein is available from Bunting Magnetic Company, Elk Grove Village, Ill. One type of flexible strip material is T type W that has equal magnetic holding strengths on both sides of the multi-polar magnet 51.

Alternatively, a suitable powdered metallic material such as iron oxide, can be mixed with rubber while it is in liquid form with the magnetic material 52 to form the multi-polar magnetic depicted in FIG. 6A. The metallic material that is used to form the magnetic material 52 can be magnetized subsequent to molding, as is known to those with ordinary skill in the art.

Figure 6B:
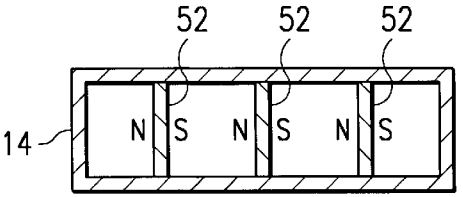

FIG. 6B, is a cross-sectional view along line 6–6' of FIG. 6A and shows that the magnetic material 52 embedded within the multi-polar magnet 51 is perpendicular to the width of the multi-polar magnet 51. As can be seen in the cross-sectional view of FIG. 6B, the magnetic poles North and South are depicted within the multi-polar magnet 51.

Figure 7B:
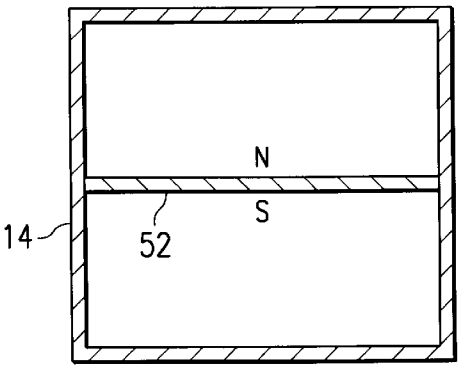
FIGS. 7A and 7B show a plan view and end view of an alternative magnet for use with the present invention in which the magnetic field is uni-polar.
Figure 7A:
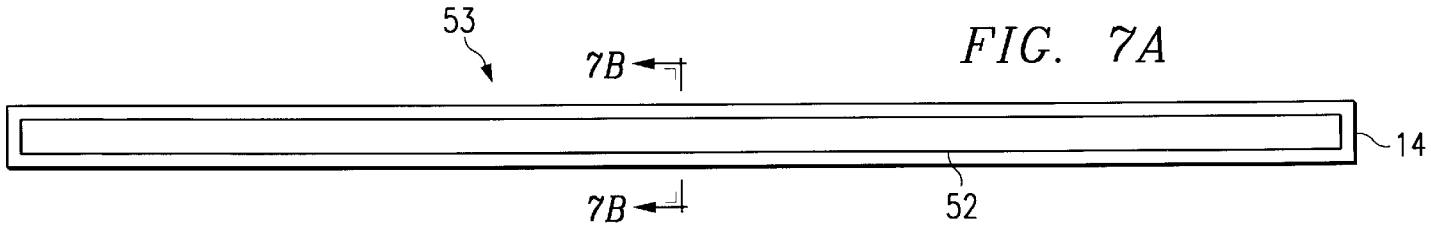

FIG. 7A shows a uni-polar version of a magnet 53 for use with the present invention. The magnetic material 52 is disposed within the magnet in an even manner as seen from the top view. In the side view depicted in FIG. 7B, which is taken along line 7–7' of FIG. 7A, the magnetic material 52 is shown in cross-section. The North and South poles of the magnetic material 52 are depicted, and show the formation of a uni-polar magnet 53 for use with the present invention.

As can be seen from the foregoing, the present invention provides a substantially improved apparatus for holding and organizing tools. The tool holder 10 of the present invention can be formed using a single piece of magnetically conductive material to form a J-shape channel 12 that has first and second magnets 14, 15. One or more first magnets 14 are used to provide retention of the tools within the opening 20. A second magnet 15 can be used to provide lateral support for the tools. The second magnet 15 allows for the use of the tool holder 10 of the present invention in a vertical tool organization system. In embodiment of the tool holder 10 of the present invention the first magnet 14 within opening 20 is a uni-polar magnet 51, and the second magnet 15 disposed along the side of first side 22 is a multi-polar magnet 53.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An apparatus for holding and organizing tools comprising;

a channel having first and second sides;

a first magnet disposed within the channel; and a magnetically conductive plate positioned on the magnet within the channel.

2. The apparatus of claim 1 further comprising a second magnet disposed along the first side of the channel.

3. The apparatus of claim 1 wherein the first magnet is a permanent magnet.

4. The apparatus of claim 3 wherein the permanent magnet is a neodymium, an Alnico, a ceramic or a flexible magnet.

5. The apparatus of claim 1 further comprising a side plate disposed on each end of the first magnet within the channel, and being integral with the channel.

6. The apparatus of claim 1 wherein the first magnet is unipolar.

7. The apparatus of claim 2 wherein the second magnet is a neodymium, an Alnico, a ceramic or a flexible magnet.

8. The apparatus of claim 2 wherein the second magnet is multi-polar.

9. The apparatus of claim 1 wherein the magnetically conductive plate further comprises at least one indentation.

10. The apparatus of claim 1 wherein the magnetically conductive plate further comprises two or more indentations, the spacing of said indentations being equidistant.

11. The apparatus of claim 10 wherein the indentations are only located in a portion of the magnetically conductive plate.

12. The apparatus of claim 1 wherein the magnetically conductive plate further comprises a ferrous coating.

13. The apparatus of claim 5 further comprising a handle attached to the side plates.

14. The apparatus of claim 1 further comprising a formed lip extending from the first side.

15. The apparatus of claim 1 further comprising a formed lip extending from the second side.

16. An apparatus for holding and organizing tools comprising:

a J-shaped channel having first and second sides, an opening, and side plates;

a first magnet disposed within the opening;

a second magnet disposed along the first side of the channel; and a magnetically conductive plate positioned on the first magnet within the opening.

17. The apparatus of claim 16 wherein the first and second magnets are selected from the group consisting of neodymium, Alnico, ceramic or flexible magnets.

18. The apparatus of claim 16 wherein the magnetically conductive plate further comprises indentations.

19. The apparatus of claim 18 wherein the indentations that are equidistant.

20. The apparatus of claim 16 wherein the indentations are only located in a portion of the magnetically conductive plate.

21. The apparatus of claim 16 further comprising a handle attached to the side plates of the J-shaped channel.

22. The apparatus of claim 16 wherein the first magnet is unipolar and the second magnet is multi-polar.

23. The apparatus of claim 16 further comprising a formed lip extending from the first side.

24. The apparatus of claim 16 further comprising a formed lip extending from the second side.

25. The apparatus of claim 16 further comprising a formed lip extending from the first and second sides.

* * * * *